United States Patent [19]

Crover

[11] Patent Number: 4,596,292

[45] Date of Patent: Jun. 24, 1986

[54] SUBSOIL PENETRATING APPARATUS

[75] Inventor: Stephen E. Crover, Boring, Oreg.

[73] Assignee: The Stanley Works, New Britain, Conn.

[21] Appl. No.: 724,453

[22] Filed: Apr. 18, 1985

[51] Int. Cl.[4] ..... E21B 1/00; E21B 4/14

[52] U.S. Cl. ..... 175/19; 175/296; 173/91

[58] Field of Search ..... 175/19, 296, 92, 94, 175/414; 173/91, 125, 127, 134, 138, 137; 91/154, 282, 462

[56] References Cited

U.S. PATENT DOCUMENTS

| | | | |
|---|---|---|---|
| 2,540,161 | 2/1951 | Boden . | |
| 2,650,314 | 8/1953 | Hennigh et al. | 310/67 |
| 2,864,633 | 12/1958 | Mackie . | |
| 2,999,572 | 9/1961 | Hinckley . | |
| 3,137,483 | 6/1964 | Zinkiewicz . | |
| 3,224,734 | 12/1965 | Hill | 254/134.6 |
| 3,326,008 | 6/1967 | Baran et al. . | |
| 3,330,368 | 7/1967 | Baran et al. | 175/94 |
| 3,375,885 | 4/1968 | Scott et al. | 175/26 |
| 3,410,354 | 11/1968 | Sudnishnikov et al. | 173/125 |
| 3,465,834 | 9/1969 | Southworth, Jr. | 173/2 |
| 3,480,092 | 11/1969 | Reinold | 175/19 |
| 3,642,076 | 2/1972 | Coyne et al. | 173/91 |
| 3,651,874 | 3/1972 | Sudnishnikov et al. | 173/91 |
| 3,685,597 | 8/1972 | Kostylev et al. | 175/19 |
| 3,705,633 | 12/1972 | Sudnishnikov et al. | 173/91 |
| 3,759,335 | 9/1973 | Coyne | 173/91 |
| 3,865,200 | 2/1975 | Schmidt | 175/19 |
| 3,891,036 | 6/1975 | Schmidt | 173/91 |
| 4,109,736 | 8/1978 | Webb et al. | 175/297 |
| 4,121,672 | 10/1978 | Tkach et al. | 175/19 |
| 4,144,941 | 3/1979 | Ritter | 175/19 |
| 4,284,147 | 8/1981 | Jenne | 173/91 |
| 4,537,265 | 8/1985 | Cox et al. | 175/296 |

FOREIGN PATENT DOCUMENTS

| | | |
|---|---|---|
| 2157259 | 11/1972 | Fed. Rep. of Germany . |
| 2161732 | 7/1973 | France . |
| 1392868 | 5/1975 | United Kingdom . |
| 1406769 | 9/1975 | United Kingdom . |

*Primary Examiner*—Stephen J. Novosad

[57] ABSTRACT

A hydraulically operated self-propelled subsoil penetrating tool of the type including an elongated housing member having a penetrating nose with a forward anvil surface, the forward anvil surface defining one end of a cylindrical cavity, a rear anvil surface defines the other end of said cavity, a hammer is slideably mounted in the cavity and has impacting surfaces at either end thereof adapted to impact on the anvil surfaces, the direction of travel of the tool is being determined by the anvil upon which said hammer impacts, the hammer is slideably in said cylindrical cavity to selectively impact upon one of said anvil surfaces and has internal bores of different diameters defining forward and reverse piston surfaces, the forward piston surface area being greater than the reverse piston surface area, a valving member is slideable in one of the hammer bores between the forward and reverse piston surfaces and defines forward and rear variable volume fluid chambers. A means is provided for supplying hydraulic fluid under pressure to the rear chamber and the valving member is movable to alternately provide communication between the chambers whereby pressure of the forward piston surface propels the hammer toward the forward anvil surface, and to port the forward chamber whereby the pressure in the rear chamber acting on the rear piston surface area propels the hammer toward the rear anvil surface. A means is provided for predetermining when the forward chamber is ported to determine the direction of operation of the tool.

34 Claims, 15 Drawing Figures

SUBSOIL PENETRATING APPARATUS

FIELD OF THE INVENTION

This invention relates to self-propelled earth boring or penetrating devices sometimes referred to as "moles".

BACKGROUND OF THE INVENTION

Self-propelled earth penetrators, or moles, typically comprise a reciprocating hammer or piston member which impacts on a forward anvil surface at one end of the mole for forward motion, then returns without impacting on a rear anvil surface and repeats this action to define a bore through which piping or cabling may be passed. After creating an underground bore, the mole is retracted by causing the hammer to impact on the rear anvil only and thus move it back out of the bore it has created.

Moles generally comprise a cylindrical member having a somewhat conical point for the forward boring movement. Within the cylindrical member, a hammer may reciprocate to impact on a forward anvil for operative boring and impact upon a rear anvil to retract the tool as previously stated. The direction of motion is controlled by various valving mechanisms which may be peculiar to each different mole structure.

Self-propelled earth penetrators or moles typically are driven by an internal linearly impacting hammer that is free to slide fore and aft. Between impacts of the hammer on a front anvil, the hammer must return to the rearmost possible position without impacting on the rear anvil. Accordingly, the hammer cycle must be completely controlled by the application and removal of fluid pressure at the proper times.

More specifically, after impact on the front anvil, at some midstroke point in the retract stroke while the hammer is being accelerated toward the rear anvil, the net force on the hammer must be switched to reverse direction. Thus, propulsion pressures are switched, the hammer decelerates to a stop, reverses its direction of motion, and then accelerates toward the forward anvil.

For forward penetration into the soil, the rear anvil must of course not be impacted; although it is desired that the maximum available stroke distance be utilized for hammer acceleration in the forward direction.

Thus the problem is one of switching the forces acting on the hammer at the proper time to make the hammer coast to a stop just before the rear anvil. At end-of-stroke, after the hammer has impacted the front anvil, the forces must again be switched to restore the initial pressure conditions and commence the next cycle.

There are no known commercially acceptable hydraulically operated moles. All known commercially used moles operate under pneumatic control. The pneumatic powered moles are prone to freezing in cold weather, and also require a pressure line lubricant to prevent undue frictional wear between the relatively movable parts of the device. Moreover, to reverse directions in the known pneumatically operated moles, only awkward methods have been utilized, such as by twisting the pressure line to actuate a valve within the mole.

Accordingly, a hydraulically operated mole would be preferable from the standpoint of a greater overall efficiency on a power in, power out, basis and arranged so that direction of impact of the hammer on the anvils, and therefore the direction of movement of the mole, may be controlled merely by reversing pressure between the input and output hydraulic lines. Such a hydraulically operated mole is disclosed in U.S. Pat. No. 3,642,076. However, the mole disclosed in this patent requires duplication of control valves at either end of the mole to determine the direction of travel.

The present invention provides a new and improved hydraulically operated mole in which the direction of travel may be controlled dependent on which line hydraulic pressure is applied to and which includes a valving mechanism of simplified construction which controls the propulsion and retraction of the hammer in either direction of operation.

SUMMARY OF THE INVENTION

Briefly stated, the invention, in one form thereof, comprises an elongated cylindrical housing member or tool body defining a cavity which is longitudinally defined by internal forward and rear impacting surfaces or anvils with a hammer or piston reciprocally received within the cylindrical housing member. The forward end of the mole is formed with a substantially conical tip to facilitate boring. The hammer has internal bores of different diameters defining forward and reverse piston surfaces, the forward piston surface area being greater than the reverse piston surface area. A valving member is slideable in one of the bores in the hammer between the forward and reverse piston surfaces and defines forward and rear variable volume fluid chambers. A means is provided for supplying hydraulic fluid under pressure to the rear chamber. The valving member is movable to alternately provide communication between the chambers whereby pressure on the forward piston surface area propels the hammer toward the forward anvil surface, and to port the forward chamber whereby the pressure in the rear chamber acting on the rear piston surface propels the hammer toward the rear anvil surface, and means is provided for predetermining when said forward chamber is ported to determine the anvil upon which the hammer will impact and therefore, direction of operation of said tool.

More specifically, a hollow tube referred to as a valve tube extends axially of the housing from the rear end thereof into a central bore in the hammer. Attached to the rear end of the valve tube is a piston received in a cylinder defined in the housing. Two hydraulic lines communicate with the cylinder. Depending upon which of the hydraulic lines is pressurized, the piston will be positioned in the cylinder to determine the position of the valve tube in the hammer and the device will operate in the forward or rearward directions. Pressure in the cylinder will position the piston therein; the valve tube will be positioned for forward or reverse operation of the tool. The valve tube is internally hollow to permit return fluid flow and the valve tube defines with a concentric seal tube a passage for pressurized hydraulic fluid. The hydraulic fluid is always returned through the valve tube by means of a valve port which is communicable with a port in a valving member which is slideable in a bore in the piston hammer.

The valving member is disposed about the valve tube within an internal bore of the hammer. The hammer, valve tube and valving member generally define two axially displaced rear and forward chambers. The rear chamber is always pressurized and the forward chamber ported or depressurized to retract the hammer after forward movement and impact. The pressure differential in these two chambers acting on piston surfaces defined in the hammer determines the direction of movement of the piston. The valving member moves with respect to the valve tube and the hammer within certain limits. Valve ports are defined in the valving member to provide communication between the pressure chambers and between the forward pressure chamber and the hollow interior of the valve tube. The hammer has internal surfaces defined thereon to provide areas for the pressurized hydraulic fluid to act upon, and to move the valving member therewith, during particular phases of operation.

After a forward impact, the fluid in the forward chamber is ported through one of the valve ports in the valving member and valve tube, and pressurized fluid in the rearward chamber propels the piston toward a retracted position. This expands the rear chamber and decreases the volume of the forward chamber. As porting of the forward chamber is closed, the valving member moves with the hammer rearwardly and reaches a position where the second valve port therein provides communication between the two chambers so that both are pressurized, and the pressure in both chambers equalizes. The net effect is to decelerate the rearward movement of the hammer. Subsequently, the pressure in the forward chamber on the area upon which it acts accelerates the piston toward the forward impact surface without impact on the rear anvil. After forward impact, the foregoing operation is repeated.

In the rearward travel mode, the valve tube is retracted by its piston in the aforementioned cylinder, and the hammer moves the valving member into a position to direct fluid flow for rearward piston impact and subsequent retraction. The position of the valve port in the valve tube determines the point at which the forward chamber is ported and therefore the point at which direction of operation of the hammer commences to reverse. In the rearward mode of operation, the forward chamber is ported at a point which provides reversal of the hammer without impact on the forward anvil.

An object of this invention is to provide a new and improved hydraulically operated mole.

Another object of the invention is to provide a new and improved hydraulically operated mole of simplified construction.

A further object of this invention is to provide a hydraulically operated mole having new and improved valving means internally of the mole hammer which will control the direction of movement of the mole dependent upon which of two hydraulic lines is pressurized.

A still further object of this invention is to provide a hydraulically operated mole in which the direction of fluid flow within the hammer is the same for either forward or reverse operation and the direction of operation is determined by the point at which a fluid chamber is ported.

The features of the invention which are believed to be novel are particularly pointed out and distinctly claimed in the concluding portion of the specification. The invention, however, together with further objects and advantages thereof, may best be appreciated by reference to the following detailed description taken in conjunction with the drawings.

Figure 1:
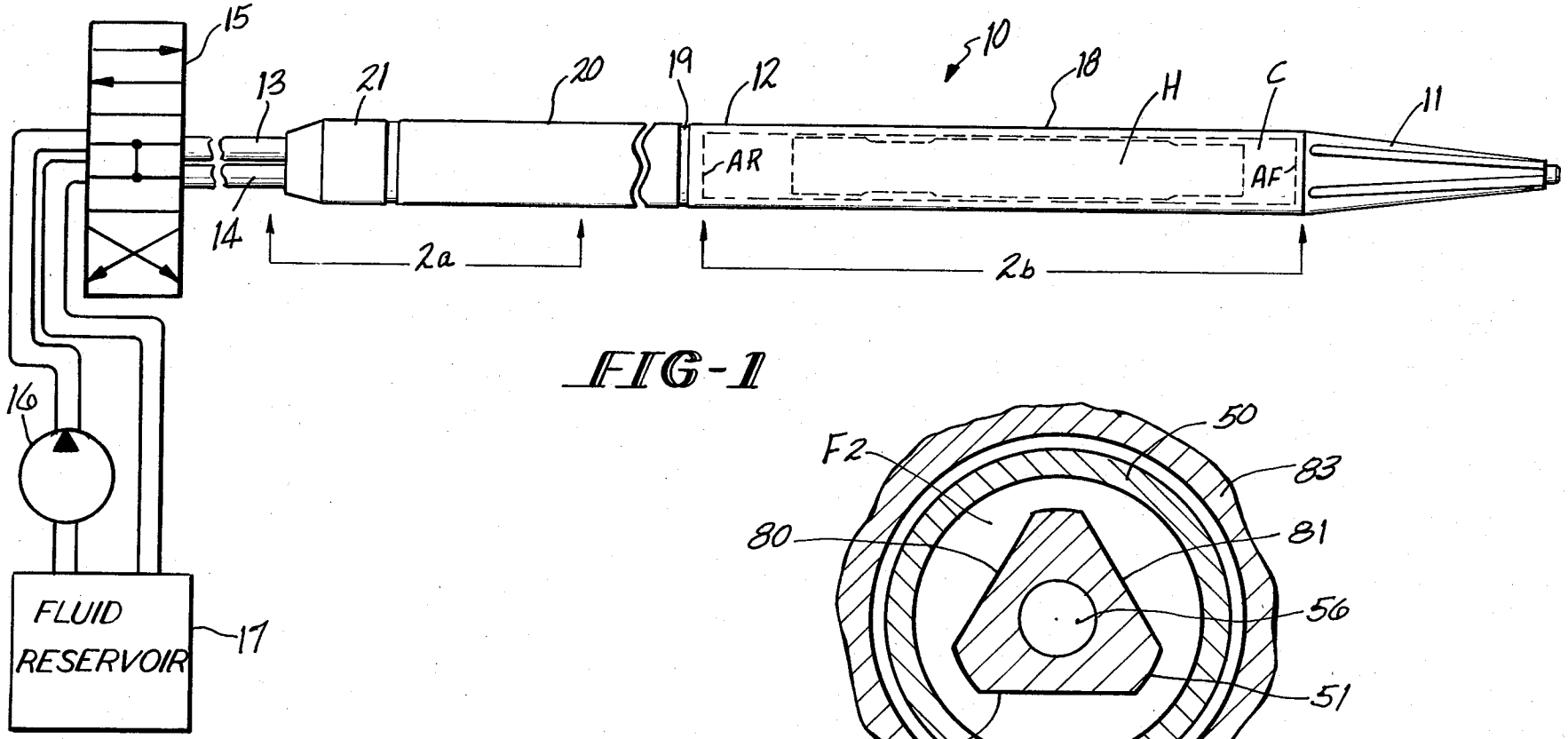
FIG. 1 is a longitudinal side elevation of a boring tool embodying the invention together with a schematic representation of controls therefor.
Figure 3:
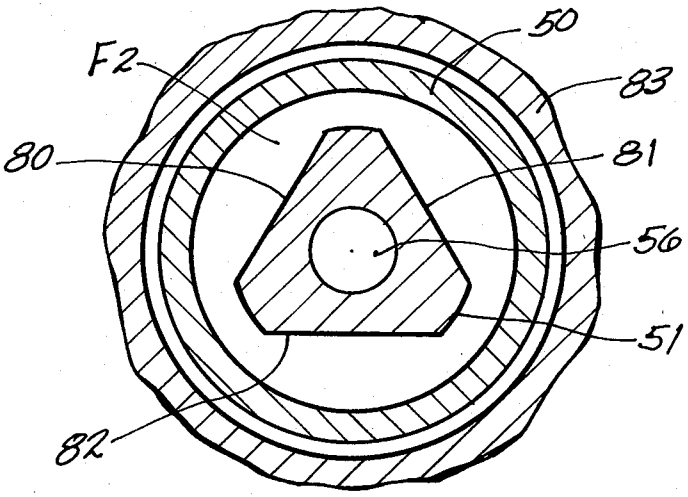

FIGS. *2a* and *2b* are longitudinal half section views of the lengths of the tool of FIG. 1 so designated in FIG. 1 when the tool is in the forward mode of operation;

FIG. 3 is a view seen in the plane of lines 3—3 of FIG. *2b*.

FIGS. 4–7 are simplified fragmentary views of a tool embodying the invention in longitudinal half section showing a portion of the mechanism of FIG. *2b*, set forth to explain the operation of the tool in a forward mode of operation.

Figure 8:
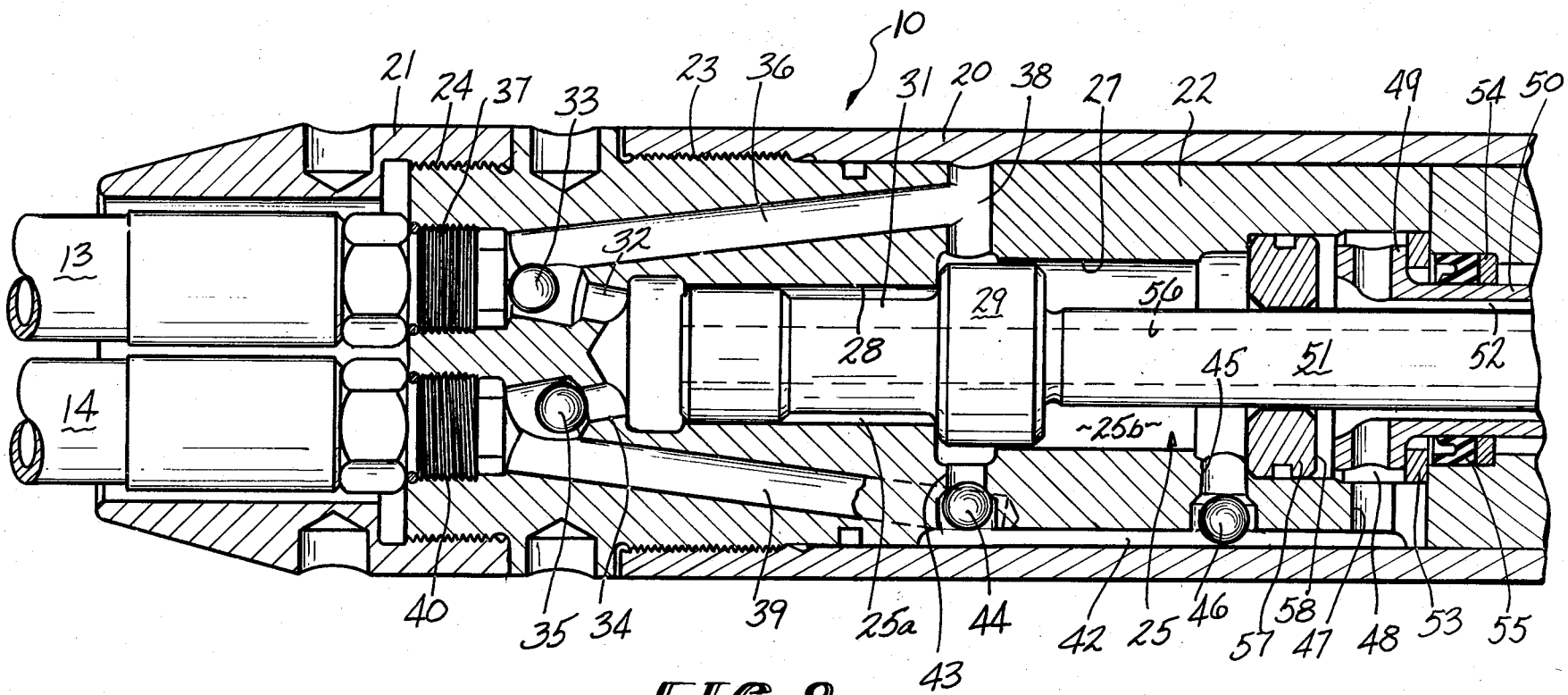

FIG. 8 is a longitudinal half section of the tool of FIG. 1 shown in the length *2a* of FIG. 1 and similar to FIG. *2a* but with the mechanism set for the reverse mode of operation; and FIGS. 9–14 are simplified fragmentary views of a tool embodying the invention in longitudinal half section showing a portion of the mechanism of FIG. *2b*, set forth to explain the operation of the tool in a reverse mode of operation.

DETAILED DESCRIPTION OF PREFERRED EMBODIMENT OF THE INVENTION

A tool embodying the invention may be generally considered to comprise two operative sections from the standpoint of hydraulic actions. A first section is responsive to one of two hydraulic lines to position in one of two positions what is referred to as a valve tube. The position of a valve port in this valve tube determines the forward or rearward operation of the tool.

The overall configuration of the tool is first described, followed by descriptions of the referenced hydraulically operative sections. A detailed description of the construction is first set forth followed by a description of the operation in the forward and reverse modes.

FIG. 1 shows a tool 10 embodying the invention having a generally conical boring or impacting head 11 and an essentially cylindrical elongated body portion 12. Fluid lines 13 and 14 are connected to the tool 10 from a reversing valve 15 which receives hydraulic fluid via a pump 16 from a hydraulic fluid reservoir 17. Pump 16 is in a pressure line while a return line extends between reversing valve 15 and hydraulic fluid reservoir 17. As will hereinafter explained, the direction of movement of the tool 10 is determined by the setting of reversing valve 15, and which of lines 13 and 14 is pressurized.

The tool 10 further comprises a cylindrical member 18 jointed to nose 11 which is threadably joined to an impact member defining a rear anvil surface AR. Member 18 and nose 11 further define a forward anvil surface AF. The anvil surfaces AR and AF define the extremities of a cylinder C within member 18. A hammer H is reciprocated within cylinder C to impact upon forward anvil surface AF in the forward mode of operation, or to impact upon rear anvil surface AR in the rearward mode of operation. Member 18 is threadably attached to an impact member 19. A further casing member 20 is also threadably attached to impact member 19, and also houses a valving control member hereinafter described. An end cap member 21 is also threadably connected to the valving control member as hereinafter described in conjunction with FIG. *2a*.

Figure 2A:
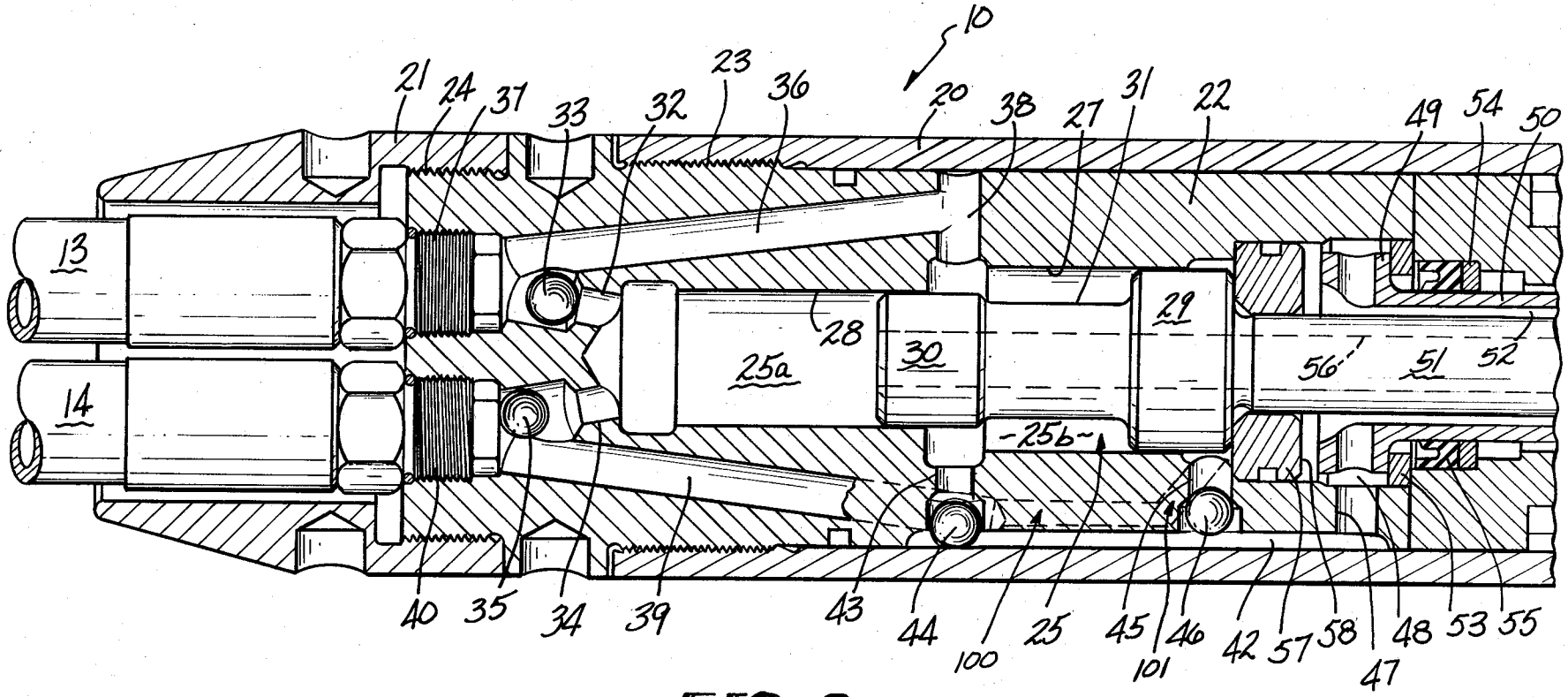
Figure 2B:
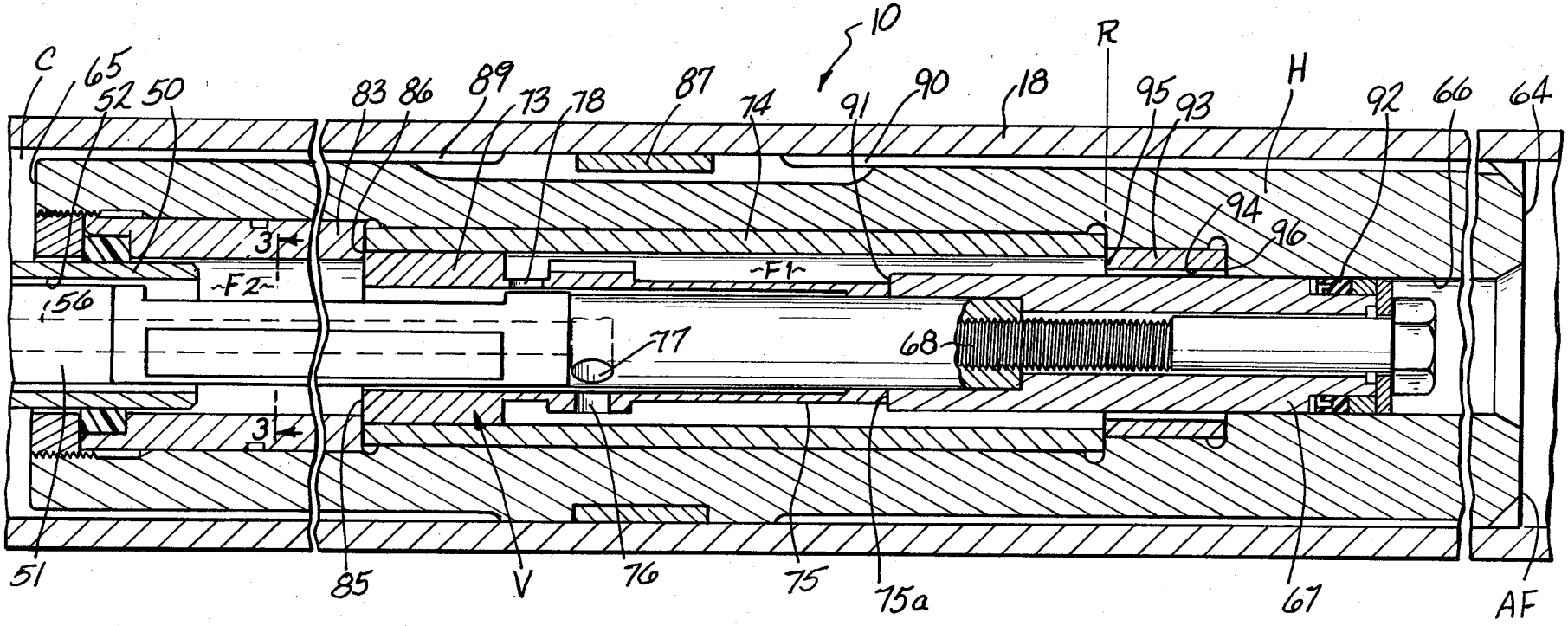

FIG. 2*a* is a cross-sectional view of the length of the tool 10 in the area of lines 2*a* of FIG. 1 and FIG. 2*b* is a cross-sectional view of the length of tool 10 in the area of lines 2*b*.

Reference is now made to FIGS. 2*a* and 2*b*. Referring first to FIG. 2*a*, within casings 20 and 21, a cylinder defining member 22 is threadably joined to casing 20 as shown at 23. End cap 21 is threadably mounted to member 22 exemplified by the reference numeral 24. As shown in FIG. 2*a*, the tool is arranged for a forward mode of operation. A cylinder 25 is defined in member 22 having two diameters 27 and 28, which receive heads 29 and 30, respectively, of a piston 31. Piston 31 may move in cylinder 25 as hereinafter described, dependent on which of lines 13 and 14 are pressurized. The smaller diameter portion 28 of cylinder 25 may communicate with line 13 via a passage 32 containing a ball check 33 depending on the position of ball check 33. As shown in FIG. 2*a*, ball check 33 prevents communication between line 13 and passage 32 due to the high pressure applied to line 13 to seat ball 33 in a closing position with respect to passage 32. The small diameter portion 28 of cylinder 26 may also communicate with line 14 via a passage 34. Passage 34 may be closed by ball check 35 when line 14 is pressurized, in which case there will be no communication between line 14 and passage 34. As shown in FIG. 2*a*, line 13 is the high pressure side and line 14 is the low pressure side.

A passage 36 extending from a coupling 37 to line 13 communicates via a passage 38 with cylinder 25. A passage 39 leads from coupling 40 of line 14 to a fluid manifold 100 which communicates with cylinder portion **25*b* via passage 101. Manifold 42 communicates with cylinder portion 25*a* via a passage 43 containing a ball check 44, and with cylinder portion 25*b* via a passage 45 also containing a ball check 46. A further passage 47 extends between manifold 42 and a pressure chamber 48. Pressure chamber 48 is defined by cylinder defining member 22 and also a flanged end 49 of a seal tube 50. Seal tube 50** defines a longitudinally extending annular high pressure passage as hereinafter described.

Seal tube 50 is concentric with and extends along the length of a valve tube 51 which is coaxially connected to piston 31. Seal tube 50 and valve tube 51 define an annular passage 52 for high pressure fluid.

An annular washer 53 ahead of the flanged end 49 of seal tube 50 and another washer 54 with a seal 55 disposed about seal tube 50 prevent leakage of fluid from chamber 48. An internal passage 56 is longitudinally defined through valve tube 51 and piston 31 for return of low pressure fluid as hereinafter described.

As shown in FIG. 2*a*, when high pressure is applied via conduit 13, ball check 33 is seated as shown, blocking communication of line 13 to passage 32, and hence cylinder chamber **25*a*. Passages 36 and 38 contain high pressure fluid which act on piston head 29 in cylinder portion 25*b* to urge the piston 31 against a valve tube cushion 57 in a chamber 48**.

With line 13 receiving the high pressure fluid, the pressure in cylinder 25 will extend to manifold 42 and close ball check 46, but hydraulic pressure will be provided to chamber 48 and the flange 49 of seal tube 50, hence to annular passage 52 between the valve tube 51 and the seal tube 50.

Cylinder chamber **25*a* is at low pressure communicating with the internal passage 56 of piston 31 and valve tube 51. The low pressure hydraulic fluid is discharged through passage 34 and coupling 40 to line 14**.

As will hereinafter be explained, it is the position of piston 31 and hence valve tube 51 in cylinders portions **25*a* and 25*b*** which determine the direction of operation of the tool.

Reference is now made to FIG. 2*b* which is a longitudinal continuation of FIG. 2*a*. Cylindrical casing member 18, which is of the same diameter as casing 20, extends to impact nose 11 and defines the cylinder C. Cylinder C is defined by forward and rearward ends by an anvil surface AF at nose 11 and at the aft end by an anvil surface AR. Piston-like hammer H has a forward impact surface 64 and a rear impact surface 65 and is slideably received in cylinder C. Hammer H defines a central bore 66 which receives a seal carrier 67 which is secured to valve tube 51 by means of a bolt 68. Disposed about valve tube 51 is a valving member V having a rear portion 73 which is slideable in a valve sleeve 74, and about valve tube 51. A sleeve-like portion 75 extends forwardly of valving member V. A valve port 76 is defined in sleeve portion 75 to provide communication to a valve port 77 defined in valve tube 51 and leading to internal passage 56 of valve tube 51. Passage 56 is a low pressure return. A further valve port 78 is defined in sleeve portion 75 and may provide fluid communication between fluid chambers as hereinafter described.

The hammer internally defines with valve tube 51 and a valving member V, two internal chambers F1 and F2. The rear chamber F2 always receives pressurized fluid via annular passage 52 about the valve tube 51.

As shown in FIG. 3, valve tube 51 is formed with three equilateral lands 80, 81, and 82 along a portion of its length which defines fluid chamber F2 with a cylindrical insert 83, and a portion of valve sleeve 74. The chambers F1 and F2 vary in volume during operation of the tool and may best be described as chambers on either side of portion 73 of valving member V.

Attention is now invited to relationship of the following surfaces. Valving member V has a valve face 85. Insert 83 is fast with hammer H and provides a piston face 86 having a piston surface area S1, hereinafter referenced. The purpose of the valve ports 76, 77, and 78 is to direct the flow of pressurized fluid and return fluid to cause hammer H to reciprocate in cylinder C. Hammer H slides on rear bearings 87 and forward bearings (not shown) on the internal peripheral walls of the cylinder C. The hammer is longitudinally relieved as shown at 89 and 90 to permit movement of air from one side of the hammer to the other when the hammer is in motion.

As shown in FIG. 2*b*, the end **75*a* of sleeve portion 75 of valving member V is in engagement with the end face 91 of seal carrier 67. End face 91** provides a forward stop for valving member V. Valving member V is in its most forward position in FIG. 2*b*. Seal carrier 67 carries a seal 92 which prevents hydraulic fluid from entering bore 66. An insert 93 defines an annular bore 94 about seal carrier 67. Insert 93 defines a piston face 95 having an area S2. Hammer H further defines a piston face 96 between seal carrier 67 and insert 93 having an area S3. As hereinafter described, bore 94 is dimensioned to close valve port 76 in valving member sleeve 75.

There are two movable parts during either mode of operation, hammer H and valving member V. Valve tube 51 moves only during the reverse mode of operation. When valving member V is positioned such that valve port 78 is not closed by valve tube 51, pressurized fluid is communicated to chamber F1 through valve port 78. Valve tube 51 is movable to forward and retracted positions to determine the direction of operation.

The longitudinal position of valve tube 51 within the cylinder determines the point at which the forward pressure chamber will be ported to the return side (low pressure) of the hydraulic system and therefore the point at which the hammer will reverse movement. When valve tube 51 is in its forward position, forward chamber F1 is ported at or just prior to impact of the hammer on the forward anvil surface and the hammer is then retracted due to pressure in the rear chamber F2 on surface S1. As the hammer retracts, the forward chamber F1 is closed and movement of the hammer H intensifies the pressure in forward chamber F1 when valve port 76 is closed, causing the valving member V to move rearwardly and the valve port 78 to provide communication between the two chambers F2 and F1 to provide equal pressure therein, where the pressure acting on larger piston surfaces S2 and S3 in the forward chamber first decelerates and stops rearward movement of the hammer, and then accelerates the hammer toward the forward anvil and upon impact, the position of valving member V again ports forward chamber F1 to retract the hammer and the sequence described above is repeated.

The forward operation of the tool will now be explained with reference to certain surfaces and diameters which are shown in FIGS. 4–7. The sequencing of operation may best be understood by bearing in mind a reference point R on hammer H which has been chosen to be the forward end of valve sleeve 74 which is also piston face 95 (surface S2). Diameter D1 is the internal diameter of valve sleeve 74,; diameter D2 is the diameter of seal carrier 67 and hence piston bore 66; diameter D3 is the outside diameter of valve tube 51 at seal carrier 67; diameter D4 is the internal diameter of valving member V at portion 73; and diameter D5 is the outside diameter of seal tube 50. These diameters or differences therebetween define areas S1–S3 upon which the hydraulic fluid acts. In FIGS. 9–13 as well as FIGS. 4–7, the forward end of valve sleeve 74 (FIG. 2*b*) is designated as a reference point R. Motion of the hammer H and valving member V may then be noted with respect to the end of seal tube 50.

FIGS. 4–7 are simplified drawings of the portion of the tool shown in FIG. 2*b* set forth for purposes of explanation of the operation of a tool embodying the invention. FIG. 2*b* exemplifies the tool just as hammer H has impacted on forward anvil surface AF during the forward mode of operation. At this time, valve tube 51 is in a forward position due to the high pressure in cylinder 25. Valving member V is held in a forward position with its forward end 75*a* contacting surface 91 of seal carrier 67 by the pressure in chamber F2 acting on valve face 85. The opposing chamber F1 is connected to the low pressure side of the system to set up necessary fluid flow passages for rearward hammer travel. Fluid in chamber F1 is ported to the low pressure side through valve ports 76, 77, and passage 56 in valve tube 51 to cylinder portion 25*a* and line 14.

Pressurized fluid acting on piston face 86 (area S1) commences to propel the hammer H (FIG. 4) towards the rear end of the tool, thus expanding chamber F2 and decreasing chamber F1. The fluid in chamber F1 has been expelled through valve port 76 in valve sleeve portion 75 and valve port 77 in valve tube 51 to the central passage 56 of valve tube 51.

Figure 4:
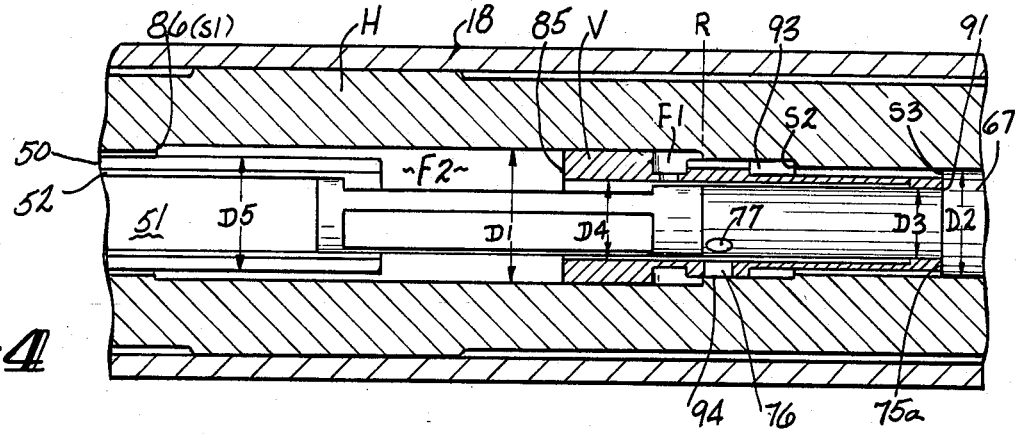

The position of the hammer shown in FIG. 4 illustrates annular bore 93 of the hammer closing valve port 76. When this occurs, the flow of fluid in chamber F1 to the internal passage 56 of valve tube 51 will be blocked. The hammer still moves rearwardly due to the pressure in chamber F2 acting on piston face 86 and piston momentum.

Figure 5:
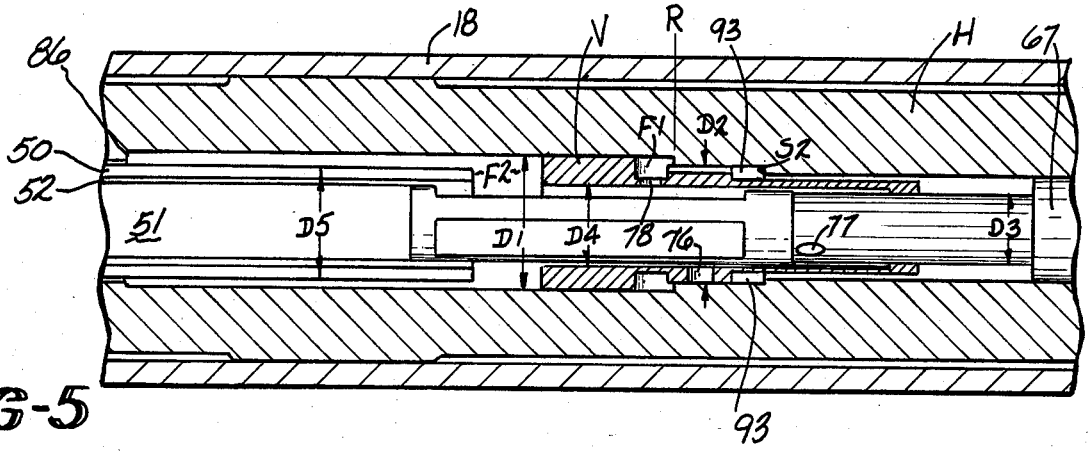

Referring now to FIG. 5, valve port 76 is fully closed by the internal surface 94 of insert 93, causing valving member V to move to the left as shown in FIG. 5. The pressure in chamber F1, due to rearward movement of hammer H which attempts to compress the fluid in chamber F1, is equal to or exceeds that of chamber F2, causing valving member V to move with hammer H in the rearward direction. The hammer is now displacing fluid relative to the difference in diameters D1 and D2 (surface S2) and the pressurized area of valving member V urging it to the rear is a function of the diameters D1 and D3, and the pressure generated in chamber F1 due to hammer travel is intensified by the ratio of the two areas. Once the valve member has moved as shown in FIG. 5, pressurized fluid acts in both chambers F2 and F1 through valve port 78, which now provides communication between chambers F2 and F1. With the chambers F1 and F2 now at equal pressure, the valving member V is held or urged toward the rear of the tool since the net differential area represented by diameter D1 minus diameter D4 is less than diameter D1 minus diameter D3.

With pressurized fluid in chambers F1 and F2, the net forces now acting on hammer H are greater in urging it toward the forward anvil surface AF since the area bounded by diameters D1 and D5 (surface S1) is less than the area bounded by diameters D1 and D2 (surface S2 and S3). The net effect is to gradually decelerate the hammer's rearward travel and to begin accelerating it in the forward direction.

Figure 6:
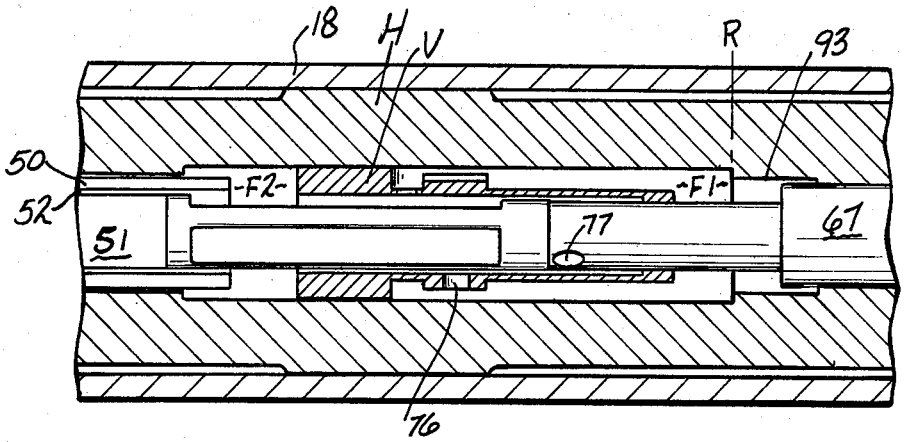

FIG. 6 shows the piston now moving toward the nose with the valving member V remaining stationary.

Figure 7:
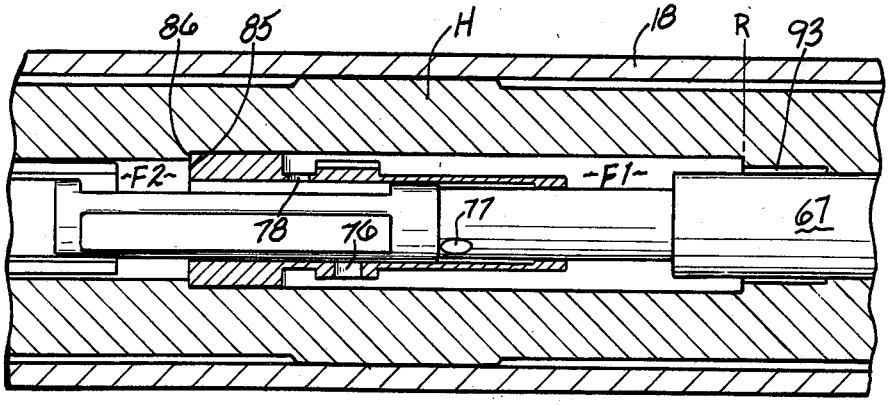

FIG. 7 shows piston face 86 contacting valve face 85 forcing the valve to move with hammer H in the forward direction. The valving member V now moves with the hammer until reaching the end 91 of sleeve member 67 in position shown in FIG. 2*b*, at which time, the hammer gives up its energy to the tool through impact on the forward anvil surface AF. At this time, chamber F1 is ported through valve ports 76 and 77 (FIG. 2*b*) to the low pressure side of the system.

The energy of the valve and/or suddenly applied pressure acting through valving member V upon shoulder 91 of seal carrier 67 attached to valve tube 51 is dissipated through the displacement of fluid in chamber 58 via valve tube cushion 57 (FIG. 2*a*).

FIG. 8 shows the piston 31 retracted when line 14 is connected to the pressure side of the system and line 13 is the return line. FIG. 8 is quite similar to FIG. 2*a*, but with the ports thereof in reversed operational positions.

To reverse the direction of travel, one merely manipulates reversing valve 15 to apply high pressure to line 14 (FIGS. 1 and 8). Prior to such reversal, the valving member V, hammer H and valve tube 51 are in the relation shown in FIG. 9. This view illustrates the turn around point between forward and rearward hammer travel. When this occurs, valve tube 51 and piston 31 assume the position shown in FIG. 9. As valve tube 51 retracts, end 91 of seal carrier 67 engages the end of valving member sleeve portion 75 and moves valving member V rearwardly.

Figure 10:
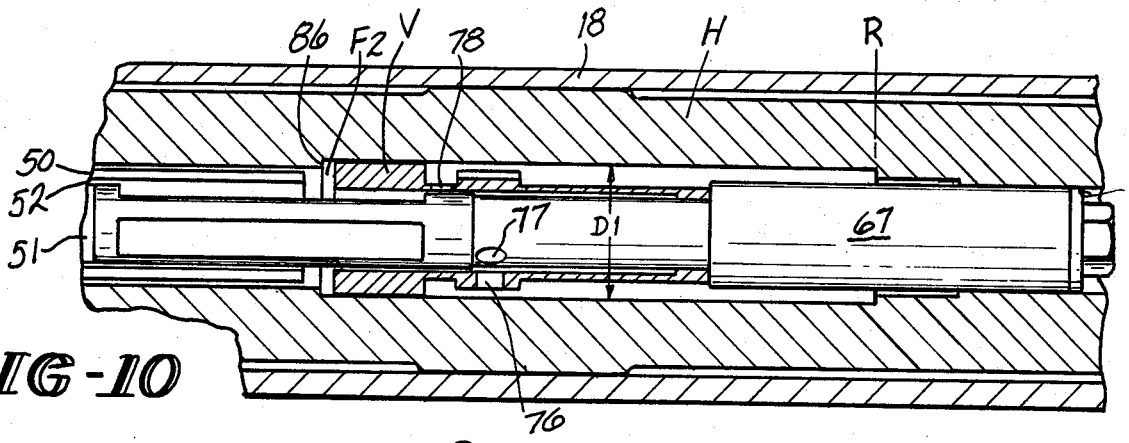

As shown in FIG. 10, piston 31 (FIG. 8) has moved the valve tube 51 into position to direct fluid flow for rearward piston travel. As piston 31 (FIG. 8) retracts, valve tube 51 travels with piston 31 and through contacting surfaces 85 and 86, and 75*a* and 91, moves valving member V and hammer H to the left. The net sum of forces applied to valve tube 51 for retraction is a function of the difference in the diameter of cylinder 25 (FIG. 8) and diameter D1 which urges valve tube 51 to its most rearward position, as shown in FIGS. 10–14.

Figure 11:
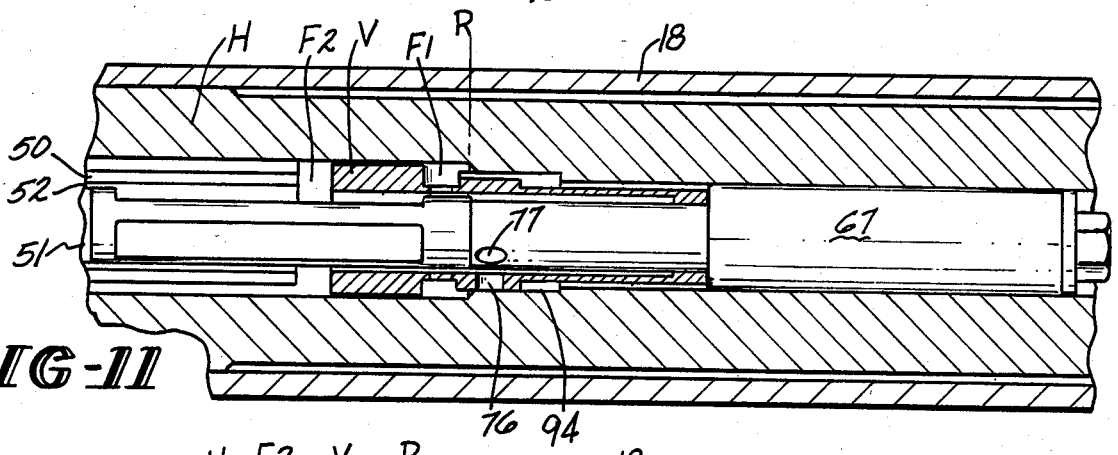

As shown in FIG. 10, hammer H has started its rearward travel due to pressure acting on piston face 86 (surface S1), allowing valve tube 51 to move to its rearward position, where it is held by the pressure in cylinder 25. Pressurized fluid acting on piston face 86 propels the hammer towards the rear of the tool, expanding chamber F2. The fluid in chamber F1 is expelled through valve port 76 and valve port 77 to the central passageway 56 extending through valve tube 51 and exiting through the rear ball check valve 33 and line 13, hammer H is now accelerating in the rearward direction, and as shown in FIG. 11, the internal periphery of bore 94 is closing valve port 76, blocking the flow of fluid from chamber F1 to the low pressure side of the system.

Figure 12:
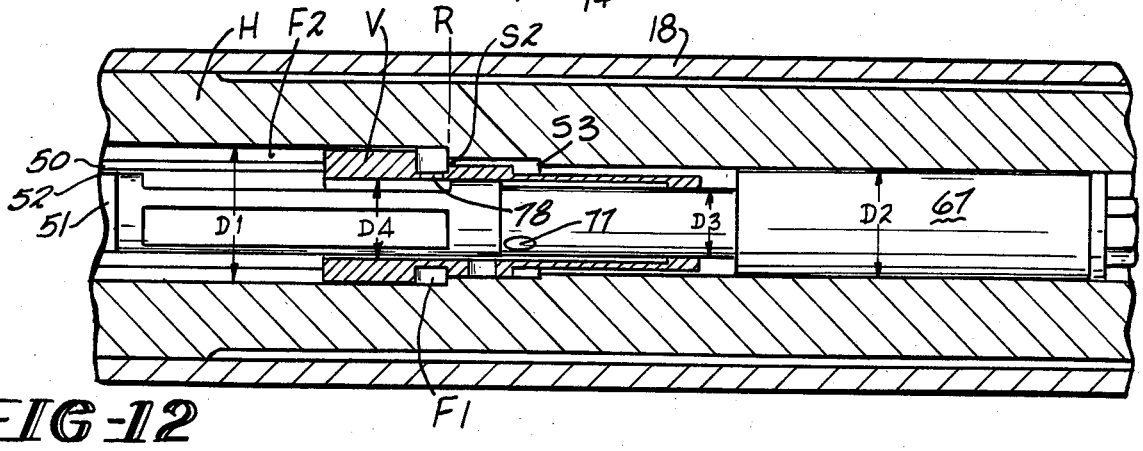

When valve port 76 is fully closed as shown in FIG. 12, the fluid pressure in chamber F1 rises to equal that in chamber F2, causing valving member V to move with hammer H in the rearward direction.

Since the hammer is displacing fluid relative to the difference of the diameters D1 and D2 (Surface S2), and the pressurized area of the valve urging it to the rear is a function of diameters D1 and D3 (Surfaces S2 and S3), pressure generated in chamber F1 due to piston travel is intensified by the ratio of the two areas. Once the valve has moved as shown in FIG. 12, valve port 78 provides communication between chambers F2 and F1 and pressurized fluid acts in both chambers F2 and F1 through valve port 78. With the chambers F1 and F2 now at equal pressure, the valving member is urged toward the rear of the tool, since the net differential area represented by diameter D1 minus diameter D4 is less than diameter D1 minus diameter D3 (surfaces S2 and S3). With pressurized fluid in both chambers F1 and F2, the net forces acting on the hammer are to urge hammer H toward the nose. Since the area bounded by diameter D1 and diameter D5 (surface S1) is less than the area bounded by diameters D1 and D2 (surfaces S2 and S3), the net effect is to gradually decelerate the hammer's travel prior to impact on rear anvil surface AR and begin acceleration in the forward direction. When hammer H comes in contact with the rear anvil surface AR, the energy resulting from the rearward piston travel is given up to the tool body through anvil surface AR to propel the tool in the rearward direction. As shown in FIG. 12, the hammer has now impacted on the rear anvil AR. At the time of impact of hammer H on rear anvil surface AR, the pressures in chambers F2 and F1 are such as to propel hammer H in the forward direction.

Figure 13:
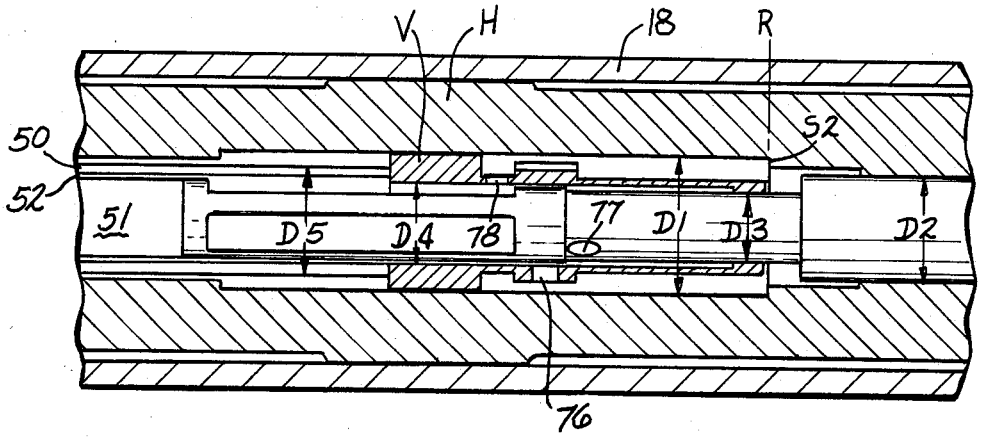

FIG. 13 shows the hammer moving toward the nose with the valving member V remaining stationary as a result of net differential pressures toward the rear represented by the difference in areas bounded by diameters D1 and D4 to the left, and diameters D1 and D3 to the right of the valving member.

Figure 9:
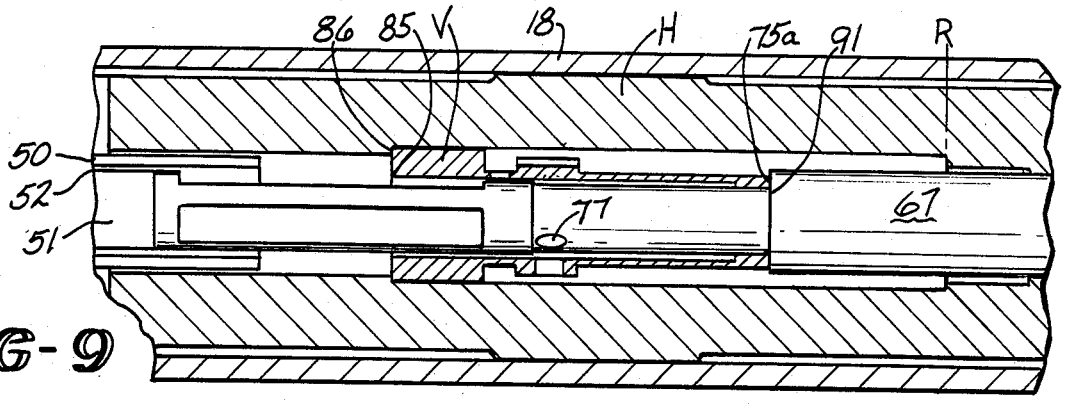
Figure 14:
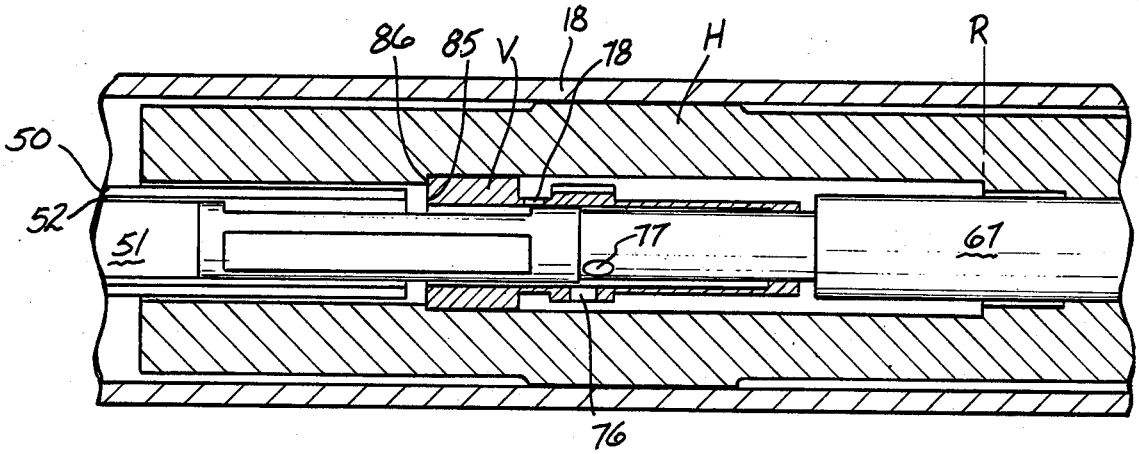

FIG. 14 illustrates the piston face 86 contacting valve face 85, forcing the valving member V and valve tube 51 to move with hammer H in the forward direction until reaching the relative position shown in FIG. 9. As the valving member V travels, valve port 78 is closed and valve port 76 is positioned to communicate with valve port 77 to connect the fluid in chamber F1 to the low pressure passage way 56 in valve tube 51 and to be expelled from the tool. The rearward mode of operation will continue so long as high pressure fluid is applied to line 14. Due to the positioning of valve tube 51 and valve port 77 therein, chamber F1 will be ported earlier in forward hammer travel and hammer H will not impact on forward anvil surface AF. Thus, the direction of operation of the tool will continue to the rear.

In some cases, it is not necessary to have the hammer impact on the rear anvil to withdraw the tool from a bore it has created. Assuming a bore is to be created under an elevated roadway, a pit may be dug on the starting side, and a pit dug on the exit side. After the bore is created, the tool is disconnected from the hydraulic lines, and removed from the exit pit, and the hydraulic lines pulled back from the bore. In cases where a bore is to be created up to a solid object such as an underground foundation, a pit may be created at the foundation to communicate with the developed bore, then the tool is retracted by means of a cable attached to the rear end thereof. Such cable may be wound on a hand operated or motor operated winch. Thus, it may be seen that for some applications, the valve tube does not have to be retractable to provide a reverse mode of operation. This eliminates the necessity for the piston 31 and the check valve system in cylinder defining member 22.

The above described structure provides a simplified control mechanism for a hydraulic boring tool and further provides a simplified construction requiring only one movable valving member for either direction of operation.

It may thus be seen that the objects of the invention set forth, as well as those made apparent from the foregoing description, are efficiently attained. While preferred embodiments of the invention have been set forth for purposes of disclosure, however, modifications to the disclosed embodiments of the invention, as well as other embodiments thereof, may occur to those skilled in the art. Accordingly, the appended claims are intended to cover all embodiments of the invention and modifications to the disclosed embodiments thereof which do not depart from the spirit and scope of the invention.

Having thus described the invention, what is claimed is:

1. A hydraulically operated self-propelled subsoil penetrating tool comprising:

A. an elongated housing member, i. said elongated housing member defining a cylindrical cavity terminating at a forward end with a forward anvil surface and terminating at a rear end with a rear anvil surface, ii. a penetrating nose on the forward end of said housing member, iii. a hammer slideably received in said cylindrical cavity and having impacting surfaces at either end thereof adapted to selectively impact on one of said anvil surfaces for a given direction of movement of said tool, B. apparatus for controlling the impact of said hammer on one of said forward or rear anvil surfaces comprising:

i. a tube member extending through said rear anvil surface into said cylindrical cavity, ii. said hammer having bores of different diameters defining forward and reverse piston surfaces, said forward piston surface area being greater than said reverse piston surface area, iii. a valving member slideable in one of said bores between said forward and reverse piston surfaces and defining forward and rear variable volume fluid chambers, iv. means for supplying hydraulic fluid under pressure to said rear chamber, v. said valving member having a first port therein providing communication from said rear chamber to said forward chamber whereby fluid under pressure in said forward chamber acts on said forward piston surface area and propels said hammer toward said forward anvil surface, vi. said tube member defining a fluid exhaust passage therein and having a valve port thereto within said forward chamber, vii. said valving member having a second valve port therein adapted to register with said tube member valve port and port said forward chamber to said fluid passage in said tube member, viii. and said hammer engaging said valving member prior to impact upon said forward anvil surface and adapted to move said valving member to a position where said second valve port and said tube member valve port are in registry, fluid is ported from said forward chamber and fluid under pressure in said rear chamber acts on said rear piston surface to retract said hammer, retraction of said hammer being effective to block said second valve port in said valving member in said forward chamber and move said valving member to a position where said first valve port provides communication to said forward chamber from said rear chamber and fluid under pressure enters said forward chamber, acts on said forward piston surface area to decelerate retraction of said hammer and then propel said hammer toward said forward anvil surface.

2. The tool of claim 1 where said tube member is longitudinally relieved along a portion of the length thereof and said relieved portion partially defines said rear chamber.

3. The tool of claim 2 wherein said first port in said valving member is opened to provide fluid communication from said rear chamber to said forward chamber when said valving member moves to a position over said relieved portion of said tube.

4. The tool of claim 1 further including a second tube extending through said rear anvil surface and defining with said tube member an annular passage which provides said means for supplying hydraulic pressure to said rear chamber.

5. The tool of claim 1 where said tube member includes means thereon providing a stop for movement of said valving member in a forward direction.

6. The tool of claim 1 where said forward piston surfaces are defined by bores in said hammer of first and second diameters, the diameter of the rearward most bore defining said forward piston surfaces being dimensioned to close said second valve port of said valving member upon retraction of said hammer to block said second valve port and prevent communication between said forward chamber and the valve port in said tube member.

7. The tool of claim 6 where said first port in said valving member provides pressurized fluid to said forward chamber after said rearmost bore defining said forward piston surfaces closes said second valve port in said valving member.

8. The tool of claim 1 wherein said tube member is movable between forward and reverse positions of operation of said tool and the position of said valve port in said tube member in said cavity determines the direction of operation of said tool.

9. The tool of claim 8 wherein a cylinder is defined in the rear end of said tool, a piston in said cylinder, said tube member attached to said piston, first and second hydraulic ports commicating with said cylinder, said ports adapted to be selectively pressurized to determine the position of said piston in said cylinder and therefore the position of said valve port in said tube member in said cylindrical cavity.

10. The tool of claim 9 further including means for selecting the port to which hydraulic fluid under pressure is applied to determine the direction of operation of said tool.

11. A hydraulically operated self-propelled subsoil penetrating tool comprising:

A. an elongated housing member, i. said elongated housing member defining a cylindrical cavity terminating at a forward end with a forward anvil surface and terminating at a rear end with a rear anvil surface, ii. a penetrating nose on the forward end of said housing member, iii. a hammer slideably received in said cylindrical cavity and having impacting surfaces at either end thereof adapted to selectively impact on one of said anvil surfaces for a given direction of movement of said tool, B. apparatus for controlling the impact of said hammer on one of said forward or rear surfaces, comprising:

i. said hammer having internal bores of different diameters defining forward and reverse piston surfaces, said forward piston surface area being greater than said reverse piston surface area, ii. a valving member slideable in one of said bores in said hammer between said forward and reverse piston surfaces and defining forward and rear variable volume fluid chambers, iii. means for supplying hydraulic fluid under pressure to said rear chamber, iv. said valving member being movable to alternately provide communication between said chambers whereby pressure on said forward piston surface area propels said hammer toward said forward anvil surface, and to port said forward chamber whereby the pressure in said rear chamber acting on said rear piston surface area propels said hammer toward said rear anvil surface, v. and means for predetermining when said forward chamber is ported to determine the direction of operation of said tool.

12. The tool of claim 11 further including means defining a cylinder toward the rear of said tool, first and second hydraulic lines communicating with said cylinder, said hydraulic lines adapted to receive hydraulic fluid under pressure from a source and return hydraulic fluid to the source, a piston positionable in said cylinder dependent upon which of said lines is pressurized, a tube member connected to said piston and extending along a passage through said rear anvil surface into said cylindrical cavity, said tube member defining a passage for fluid ported from said forward chamber and having a valve port defined therein to said passage whereby fluid may be exhausted from said forward chamber, said tube member providing said means for predetermining.

13. The tool of claim 12 further including a second tube concentric with said tube member and defining an annular passage about said tube member leading to said rear chamber, and means providing communication between the high pressure line and said annular passage, said annular passage providing said means for supplying hydraulic fluid under pressure to said rear chamber.

14. The tool of claim 12 wherein said valving member defines a valve port adapted to register with said valve port in said tube member.

15. The tool of claim 14 where said hammer contacts said valving member to move said valving member to a position where said valve port in said valving member registers with said valve port in said tube member at the end of forward motion of said hammer whereby said forward chamber is ported.

16. The tool of claim 15 where one of said bores in said hammer closes said valve port in said valving member as said hammer moves in a rearward direction.

17. The tool of claim 16 wherein said hammer acts to compress fluid in said forward chamber as it moves rearward and causes said valve to move rearward.

18. The tool of claim 17 where said valving member defines a second valve port therein adapted to provide communication between said rear and forward chambers when said valving member moves rearward.

19. The tool of claim 18 where said tube member is partially relieved along a length thereof which defines a portion of said rear chamber and said first and second chambers are in fluid communication when said second valve port in said valving member is over said relieved portion.

20. The tool of claim 14 where said tube member extends into a bore in said hammer and receives a member on the end thereof which provides a stop for forward movement of said valving member to determine registry of said valve port in said valving member and said valve port in said tube member.

21. A hydraulically operated self-propelled subsoil penetrating tool comprising:

A. an elongated housing member, i. said elongated housing member defining a cylindrical cavity terminating at a forward end with a forward anvil surface end terminating at a rear end with a rear anvil surface, ii. a penetrating nose on the forward end of said housing member, iii. a hammer slideably received in said cylindrical cavity and having impacting surfaces at either end thereof adapted to selectively impact on one of said anvil surfaces for a given direction of movement of said tool, B. apparatus for controlling the impact of said hammer on one end of said forward or rear surfaces, comprising:

i. said hammer having bores of different diameters defining forward and reverse piston surfaces, said forward piston surface area being greater than said reverse piston surface, ii. a valving member slideable in one of said bores in said hammer between said forward and reverse piston surfaces and defining forward and rear variable volume fluid chambers, iii. means for supplying hydraulic fluid under pressure to said rear chamber, iv. said valving member being adapted to move with said hammer to alternately provide communication between said chambers whereby said hammer is propelled toward said forward anvil surface, and to port said forward chamber upon impact of said hammer on said forward anvil surface whereby the pressure in said rear chamber acting on said rear piston surface retracts said hammer until said valving member again provides communication between said chambers and the pressure acting on the piston surface area in said forward chamber decelerates retractive movement of said hammer and then again propels said hammer toward said front anvil surface.

22. A hydraulically operated self-propelled subsoil penetrating tool comprising:

A. an elongated housing member, i. said elongated housing member defining a cylindrical cavity terminating at a forward end with a forward anvil surface and terminating at a rear end with a rear anvil surface, ii. a penetrating nose on the forward end of said housing member, iii. a hammer slideably received in said cylindrical cavity and housing impacting surfaces at either end thereof adapted to selectively impact on one of said anvil surfaces for a given direction of movement of said tool, B. apparatus for controlling the impact of said hammer on one of said forward or rear surfaces, comprising:

i. said hammer having bores of different diameters defining forward and reverse piston surfaces, said forward piston surface area being greater than said reverse piston surface, ii. a valving member slideable on one of said bores in said hammer between said forward and reverse piston surface areas and defining forward and rear variable volume fluid chambers, iii. means for supplying hydraulic fluid under pressure to said rear chamber, iv. said valving member being adapted to move with said hammer to alternately port said forward chamber and provide communication between said chambers whereby said hammer is propelled toward said rear anvil surface when said forward chamber is ported and upon impact on said rear anvil surface communication is provided between said chambers whereby the pressure in said forward chamber acting on said forward piston surface area retracts said hammer from said rear anvil surface until said valving member again provides ports between said forward chamber and the pressure acting on the piston surface in said rear chamber decelerates retractive movement of said hammer and then again propels said hammer toward said rear anvil surface.

23. A hydraulically operated self-propelled subsoil penetrating tool comprising:

A. an elongated housing member i. said elongated housing member defining a cylindrical cavity terminating at a forward end with a forward anvil surface and terminating at a rear end with a rear anvil surface, ii. a penetrating nose on the forward end of said housing member, iii. a hammer slideably received in said cylindrical cavity and having impacting surfaces at either end thereof adapted to selectively impact on one of said anvil surfaces for a given direction of movement of said tool, B. apparatus for controlling the impact of said hammer on one of said forward or rear surfaces, comprising:

i. a first tube member extending through said rear anvil surface into said cavity, ii. a second tube disposed about said first tube member and defining an annular passage therewith, iii. said first tube member having a longitudinal passage defined in the length thereof to a valve port extending from the periphery of said first tube member, said first tube member extending beyond said second tube member and having a sealing member which extends into a first coaxial bore in said hammer, said sealing member having rear surfaces providing a stop for a valving member, iv. a second bore defined in said hammer of greater diameter than said first bore and aft of said first bore, v. a valving member surrounding said first tube and having a portion slideable on walls defining said second bore, said valving member defining forward and rear variable volume pressure chambers, v. a third bore aft of said second bore of lesser diameter than said second bore and defining a piston face, vii. said valving member having a forwardly extending sleeve portion, viii. a valve port in said sleeve portion adapted to sometimes register with the valve port in said first tube, said valving member sleeve having a second valve port therein adapted to provide fluid communication between said first and second chambers dependent on the position of said hammer, ix. said annular passage providing a conduit for high pressure fluid to said rear chamber, x. said passage in said first tube being connected to the low pressure side of the hydraulic system, xi. said valve port in said first tube member being in registry with said first valve port in said sleeve portion of said valving member when said hammer impacts on said forward anvil surface whereby said forward pressure chamber is connected to the low pressure side of the system and pressure in said rear chamber acts on said piston face defined by said third bore to commence retracting said hammer and expanding said rear pressure chamber, xii. said hammer having a fourth bore between said first and second bores of a diameter which will close said first valve port in said sleeve portion of said valving member whereby as said hammer retracts communication between said forward chamber and said passage in said first tube member is blocked, said retracting movement of said hammer moving said valving member rearwardly so that said second valve port in said sleeve portion of said valving member provides communication between said forward and rear chambers and both chambers are pressurized, xiii. said first and third bores defining forward piston faces of an area greater than said third bore, whereby when both of said chambers are pressurized, the pressure on said forward piston surfaces decelerate rearward movement of said hammer and then propel said hammer toward said forward anvil surface.

24. The tool of claim 23 where said first tube member is longitudinally movable to position the valve port therein to determine the point where said first chamber is ported.

25. The tool of claim 24 further comprising means for longitudinally moving said first tube member in accordance with selected direction of movement of said tool.

26. The tool of claim 25 where said means for longitudinally moving said first tube member comprises means defining a cylinder in said tool toward the rear end thereof, a piston in said cylinder, said first tube member being connected to said piston, first and second ports adapted to be selectively pressurized connectable to said cylinder, the pressurization of one of said ports determining the position of said piston in said cylinder.

27. A hydraulically operated self-propelled subsoil penetrating tool comprising:

A. an elongated housing member, i. said elongated housing member defining a cylindrical cavity terminating at a forward end with a forward anvil surface and closed at a rear end, ii. a penetrating nose on the forward end of said housing member, iii. a hammer slideably received in said cylindrical cavity and having an impacting surface at the forward end thereof adapted to impact on said forward anvil surface, B. apparatus for controlling the impact of said hammer on said forward anvil surface comprising:

i. a tube member extending through the rear end of said cylindrical cavity, ii. said hammer having bores of different diameters defining forward and reverse piston surfaces, said forward piston surface area being greater than said reverse piston surface area, iii. a valving member slideable in one of said bores between said forward and reverse piston surfaces and defining forward and rear variable volume fluid chambers, iv. means for supplying hydraulic fluid under pressure to said rear chamber, v. said valving member having a first port therein providing communication from said rear chamber to said forward chamber whereby fluid under pressure in said forward chamber acts on said forward piston surface area and propels said hammer toward said forward anvil surface, vi. said tube member defining a fluid exhaust passage therein and having a valve port thereto within said forward chamber, vii. said valving member having a second valve port therein adapted to register with said tube member valve port and port said forward chamber to said fluid passage in said tube member, viii. and said hammer engaging said valving member prior to impact upon said forward anvil surface and adapted to move said valving member to a position where said second valve port and said tube member valve port are in registry, fluid is ported from said forward chamber and fluid under pressure in said rear chamber acts on said rear piston surface to retract said hammer, retraction of said hammer being effective to block said second valve port in said valving member in said forward chamber and move said valving member to a position where said first valve port provides communication to said forward chamber from said rear chamber and fluid under pressure enters said forward chamber, acts on said forward piston surface area to decelerate retraction of said hammer and then propel said hammer toward said forward anvil surface.

28. The tool of claim 27 where said tube member is longitudinally relieved along a portion of the length thereof and said relieved portion partially defines said rear chamber.

29. The tool of claim 28 wherein said first port in said valving member is opened to provide fluid communication from said rear chamber to said forward chamber when said valving member moves to a position over said relieved portion of said tube.

30. The tool of claim 27 further including a second tube extending through said rear anvil surface and defining with said tube member an annular passage which provides said means for supplying hydraulic pressure to said rear chamber.

31. The tool of claim 27 where said tube member includes means thereon providing a stop for movement of said valving member in a forward direction.

32. The tool of claim 27 where said forward piston surfaces are defined by bores in said hammer of first and second diameters, the diameter of the rearward most bore defining said forward piston surfaces being dimensioned to close said second valve port of said valving member upon retraction of said hammer to block said second valve port and prevent communication between said forward chamber and the valve port in said tube member.

33. The tool of claim 32 where said first port in said valving member provides pressurized fluid to said forward chamber after said rearmost bore defining said forward piston surfaces closes said second valve port in said valving member.

34. A hydraulically operated self-propelled subsoil penetrating tool comprising:

A. an elongated housing member,
   i. said elongated housing member defining a cylindrical cavity terminating at a forward end with a forward anvil surface and closed at a rear end,
   ii. a penetrating nose on the forward end of said housing member,
   iii. a hammer slideably received in said cylindrical cavity and having an impacting surface at the forward end thereof adapted to impact on said forward anvil surface, B. apparatus for controlling the impact of said hammer on said forward anvil surface comprising:
   i. said hammer having internal bores of different diameters defining forward and reverse piston surfaces, said forward piston surface area being greater than said reverse piston surface area,
   ii. a valving member slideable in one of said bores between said forward and reverse piston surfaces and defining forward and rear variable volume fluid chambers, and
   iii. means for supplying hydraulic fluid under pressure to said rear chamber,
   iv. said valving member being movable to alternately provide communication between said chambers whereby pressure on said forward piston surface area propels said hammer toward said forward anvil surface, and to port said forward chamber whereby the pressure in said rear chamber acting on said rear piston surface area retracts said hammer toward said closed rear end prior to further forward movement of said hammer.

* * * * *